United States Patent [19]

Camilleri

[11] 4,234,182

[45] Nov. 18, 1980

[54] LINER FOR DECK CHUTE

[76] Inventor: Thomas M. Camilleri, 277 Avenue W, Brooklyn, N.Y. 11223

[21] Appl. No.: 873,382

[22] Filed: Jan. 30, 1978

[51] Int. Cl.[3] ..... A63D 5/00

[52] U.S. Cl. ..... 273/42 R; 46/1 L; 193/2 R; 229/4.5

[58] Field of Search ..... 273/42 R, 42 A, 43 R, 273/43 A; 220/62; 229/4.5; 427/207 D; 428/295, 353, 354; 156/94; 193/2 R; 46/1 L

[56] References Cited

U.S. PATENT DOCUMENTS

| | | | |
|---|---|---|---|
| 147,710 | 2/1874 | Thomson | 229/4.5 |
| 562,674 | 6/1896 | Spiegle | 46/1 L |
| 2,406,164 | 8/1946 | Raisz | 428/542 X |
| 3,172,662 | 3/1965 | Boyle et al. | 273/42 R |
| 3,232,611 | 2/1966 | Fossberg | 273/42 R |
| 3,256,017 | 6/1966 | Dowd et al. | 273/43 R |
| 3,317,207 | 5/1967 | Jark et al. | 273/43 R |
| 3,917,153 | 11/1975 | Holschneider | 46/1 L X |
| 4,037,354 | 7/1977 | ChaBakKuk | 46/1 L |

FOREIGN PATENT DOCUMENTS

| | | | |
|---|---|---|---|
| 240486 | 9/1962 | Australia | 427/207 D |
| 681631 | 3/1964 | Canada | 273/42 R |

*Primary Examiner*—Anton O. Oechsle
*Attorney, Agent, or Firm*—Donald J. Perrella

[57] ABSTRACT

A deck chute for an automatic pinsetter is provided with a lining of low coefficient of friction material.

11 Claims, 2 Drawing Figures

LINER FOR DECK CHUTE

BACKGROUND OF THE INVENTION

The present invention relates to automatic pinsetter bowling machines and, more particularly, to the deck chutes of such machines.

A deck chute consists of a funnel-like member formed of an elastomeric material such as rubber or polyurethane. A bowling pin enters a deck chute at the top and is fed by gravity down the chute to the pin deck, the mechanism which sets the pins for the bowler's first ball. Sometimes a bowling pin becomes stuck in the chute and fails to pass through to the pin deck. When this happens, the stuck pin must be freed manually. This delays the game and is a source of annoyance to the bowler by delaying the game. A delay also means a loss of revenue for the bowling center as fewer games can be played on the affected pinsetter. More serious, however, is the tendency of the deck chute to crack and break while in use. When this happens the foregoing problems are magnified to such an extent that the deck chute must be removed and replaced.

OBJECTS OF THE INVENTION

It is, accordingly, an object of the present invention to provide an improved deck chute. Another object is to provide a deck chute which insures pasage of the pin to the pin deck. A further object is to provide means which can be readily and easily installed in a deck chute to insure passage of the pin to the pin deck, particularly when the interior surface of the deck chute and/or the surfaces of the pin which contact the interior surface of the deck chute have become scuffed or worn so that friction between the deck chute and pin surfaces has considerably increased. Still another object is to avoid the necessity of removing and replacing cracked and/or broken deck chutes. Yet another object is to extend and prolong the useful life of uncracked and unbroken deck chutes. These and other objects of the present invention will be apparent from the following description.

SUMMARY OF THE INVENTION

A deck chute for an automatic pinsetter bowling machine is provided with a separate, unitary liner formed of a material having a low coefficient of friction with respect to contacting surfaces of the bowling pins.

DETAILED DESCRIPTION

Figure 1:
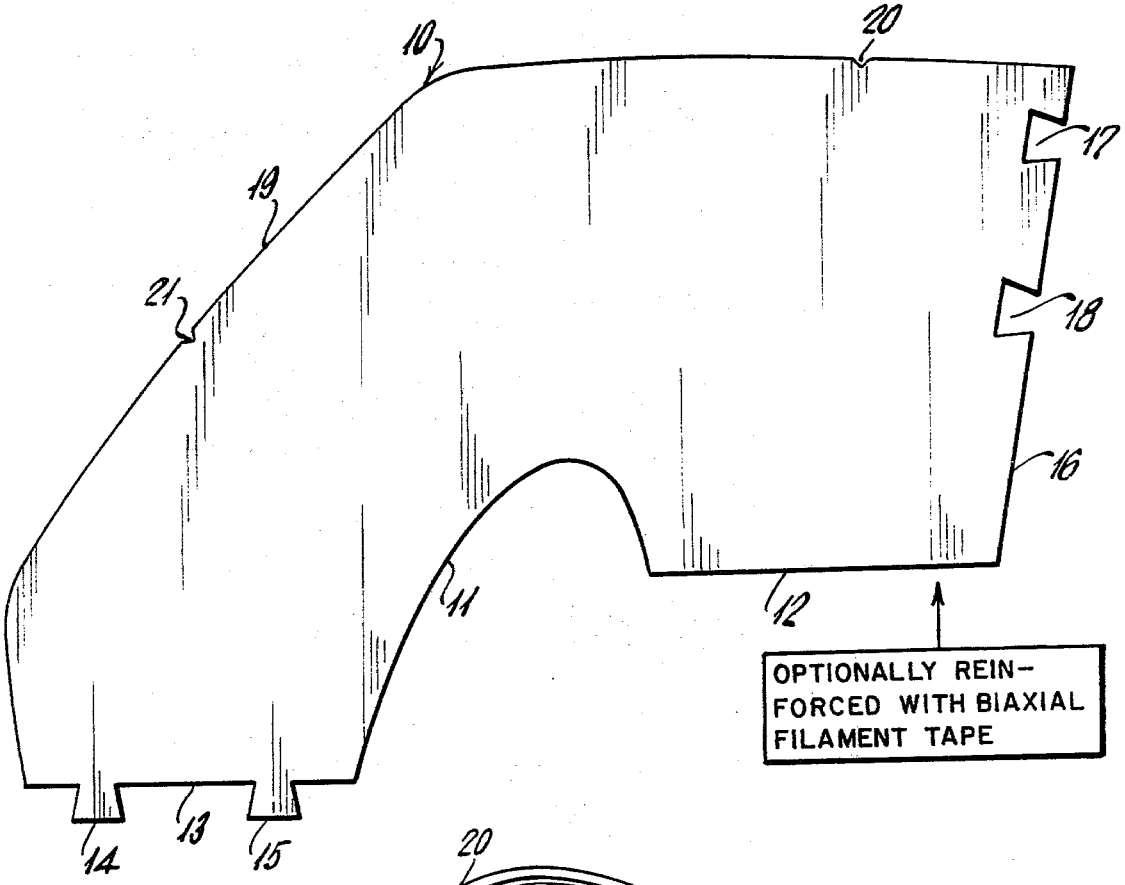
FIG. 1 is a plan view of a deck chute liner blank, which is a planar development of that portion of the interior surface of the deck chute to be lined.
Figure 2:
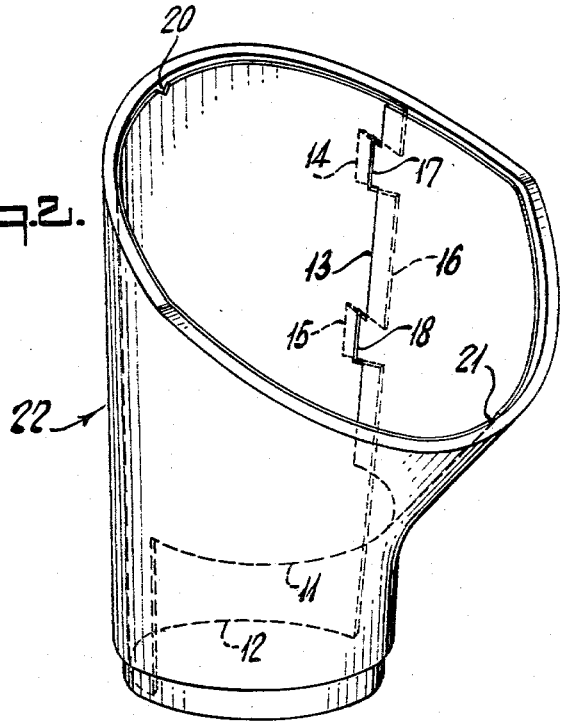
FIG. 2 is a perspective view of a deck chute with a liner inserted therein.

As shown in the drawings a deck chute liner blank of the present invention consists of a strip 10 having a substantially arcuate section 11 joined to a substantially rectangular section 12. Section 11 has an edge 13 provided with tabs 14 and 15. Section 12 has an edge 16 provided with notches 17 and 18. Tabs 14 and 15 are adapted to dovetail with notches 17 and 18, respectively, when the deck chute liner is formed for insertion into a deck chute so that edges 13 and 16 abut one another. It is to be understood, however, that the number of tabs, their shape, and their location are not critical. Preferably, the top edge 19 of deck chute liner 10 is provided with positioning indicia in the form of notches 20 and 21. Notch 20 identifies the front center of the folded deck chute liner while notch 21 identifies the rear center. These notches facilitate correct positioning of the deck chute liner within the deck chute. The deck chute liner preferably is cut from a sheet of plastic material such as, for example, nylon or Teflon, having a low coefficient of friction with respect to the contacting surfaces of the bowling pins. By a low coefficient of friction is meant a coefficient of friction sufficiently low to avoid the sticking of a pin in a deck chute. More specifically by a low coefficient of friction is meant one which is lower than that resulting from the contact of a bowling pin with the rubber or polyurethane surface of the deck chute. Preferably the coefficient of friction is about 0.2, or below about 0.2.

When formed as described above, the deck chute liner conforms to the shape of the deck chute 22 and readily can be slipped inside the deck chute. Because of its conforming shape, the deck chute liner maintains its shape and position within the deck chute. Because the deck chute liner is formed of a material selected for a low coefficient of friction with respect to the pins, a bowling pin entering the chute contacts the deck chute liner and slips through the deck chute without jamming or or blocking.

The deck chute liner of this invention not only provides a means of assuring better performance and longer life of the deck chute of an automatic pinsetter when installed in an uncracked or unbroken deck chute, but also actually avoids the necessity of replacing cracked and/or broken deck chutes and enables such cracked and/or broken deck chutes to function as if new.

If the deck chute contains a large crack or if a part of the liner has broken off and is missing, the deck chute liner itself is liable to crack in some instances. This is not a serious problem as the liner is readily installed and removed without disassembly or removal of the deck chute. However, cracking of the deck chute liner may be avoided by means of a reinforcing member which imparts strength and resiliency to the deck chute liner and enables it to resist cracking due to the impact of the pin. This reinforcing member may be, for example, a strip of material attached to all or part of the outer layer of the liner which contacts the deck chute. This embodiment is not shown as obvious. Such a layer may be, for example, a tape, such as a biaxial filament tape having a pressure sensitive adhesive on one surface. Such a tape may be adhered to the uncut blank from which the deck chute liner is cut. It is to be understood, however, that other reinforcing members may be employed such as cloth, plastic, metal and any other material suitable for this purpose.

While the present invention has been described with reference to specific dovetailing means to join the ends of the deck chute liner, it is to be understood that other fastening means may equally be used, for example, Velcro fasteners. It is also to be understood that specific fastening means may be omitted entirely and the ends of the deck chute liner fastened together or to the deck chute by adhesive means.

What is claimed is:

1. In an automatic pinsetter having a deck chute adapted to serve as a conduit through which a bowling pin passes on route to its spot on a bowling alley floor, the improvement wherein the deck chute is provided with a lining conforming releasably to substantially all of its interior surface by abutting two ends of a separate and unitary liner formed of a material having a coefficient of friction sufficiently low with respect to contacting surfaces of the bowling pin to avoid sticking of the bowling pin in the deck chute, the outer surface of the lining being provided with a separate, external reinforcing member which imparts strength and resiliency to the lining.

2. In an automatic pinsetter according to claim 1, the improvement wherein the reinforcing member is a filament tape.

3. In an automatic pinsetter according to claim 2 the improvement wherein the reinforcing member is a biaxial filament tape.

4. A flexible blank adapted to conform to substantially all of the interior surface of a deck chute and to be removably inserted in a deck chute in an automatic pinsetter bowling machine, the blank comprising substantially a planar development of substantially all of the deck chute interior surface to be lined, the blank being formed of a material having a low coefficient of friction with respect to contacting surfaces of a bowling pin, the blank surface contacting the deck chute being provided with a separate, external reinforcing member which imparts strength and resiliency to the lining.

5. A blank according to claim 4 including releasable fastening means to retain the blank in a shape conforming to said deck chute interior surface.

6. A blank according to claim 5 wherein the fastening means comprises tabs and notches.

7. A blank according to claim 4 wherein the blank material is nylon or Teflon.

8. A blank according to claim 4 wherein the reinforcing member is a filament tape.

9. A blank according to claim 8 wherein the reinforcing member is a biaxial filament tape.

10. A blank according to claim 4 wherein the blank material is nylon.

11. A blank according to claim 4 wherein the reinforcing member is in the form of a strip of material.

* * * * *